US005737791A

United States Patent [19]

Durigon

[11] Patent Number: 5,737,791

[45] Date of Patent: Apr. 14, 1998

[54] CLEANER FOR A SUBMERGED SURFACE

[76] Inventor: Duilio Durigon, 61 Homestead Road, Rau Marais Park, Sandton, South Africa

[21] Appl. No.: 656,786

[22] Filed: May 31, 1996

[30] Foreign Application Priority Data

May 31, 1995 [ZA] South Africa ..... 95/4449

[51] Int. Cl.[6] ..... E04H 4/16

[52] U.S. Cl. ..... 15/1.7; 15/404; 137/624.14; 137/907

[58] Field of Search ..... 15/1.7, 404; 137/624.14, 137/907; 251/324; 210/169

[56] References Cited

U.S. PATENT DOCUMENTS 4,729,406 3/1988 Frentzel ..... 137/624.14
4,766,931 8/1988 Chauvier et al. ..... 15/1.7 X

FOREIGN PATENT DOCUMENTS 2748387 5/1979 Germany ..... 210/169
2182551 5/1987 United Kingdom ..... 210/169

*Primary Examiner*—Mark Spisich
*Attorney, Agent, or Firm*—Birch, Stewart, Kolasch & Birch, LLP

[57] ABSTRACT

A swimming pool cleaner has a body which defines a liquid inlet and an outlet which is connected via a hose to a source of suction. A throat between the inlet and the outlet defines a region of reduced cross-sectional area, causing a zone of low pressure as liquid flows through the throat. A valve element in the form of a cylindrical shuttle is located in a bore which intersects the throat, and which can move into the throat to block it intermittently. An auxiliary suction passage connects the rear of the bore to the outlet, so that suction is applied to both ends of the shuttle, causing it to reciprocate in the bore, periodically obstructing the flow of liquid through the throat. This causes the cleaner to move across the submerged surface. The design of the cleaner makes it resistant to jamming due to objects being trapped between the valve element and the throat.

13 Claims, 6 Drawing Sheets

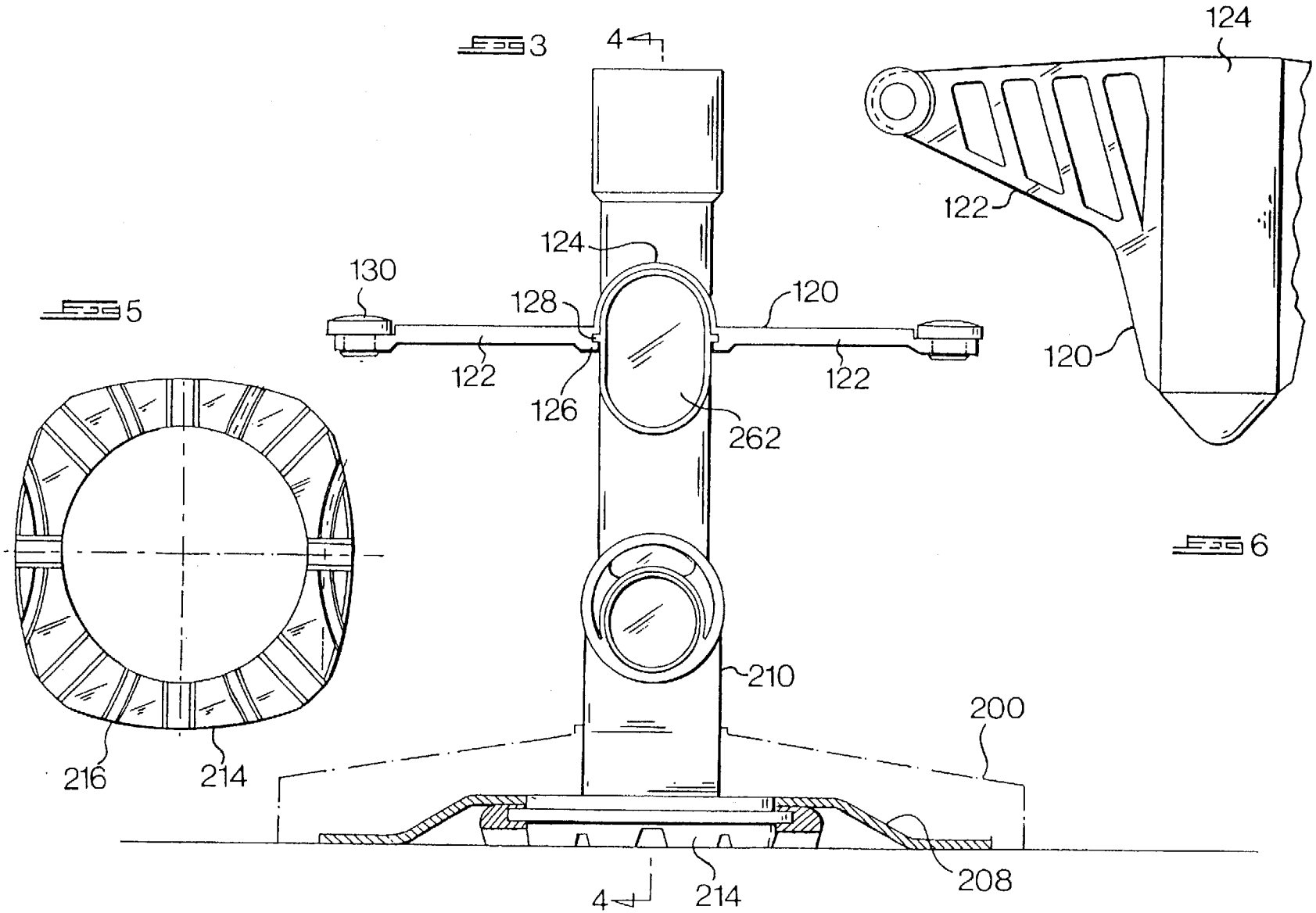
124
120
122
6
120
122
262
210
200
208
214
4
4
124
128
126
122
130
3
214
216
5

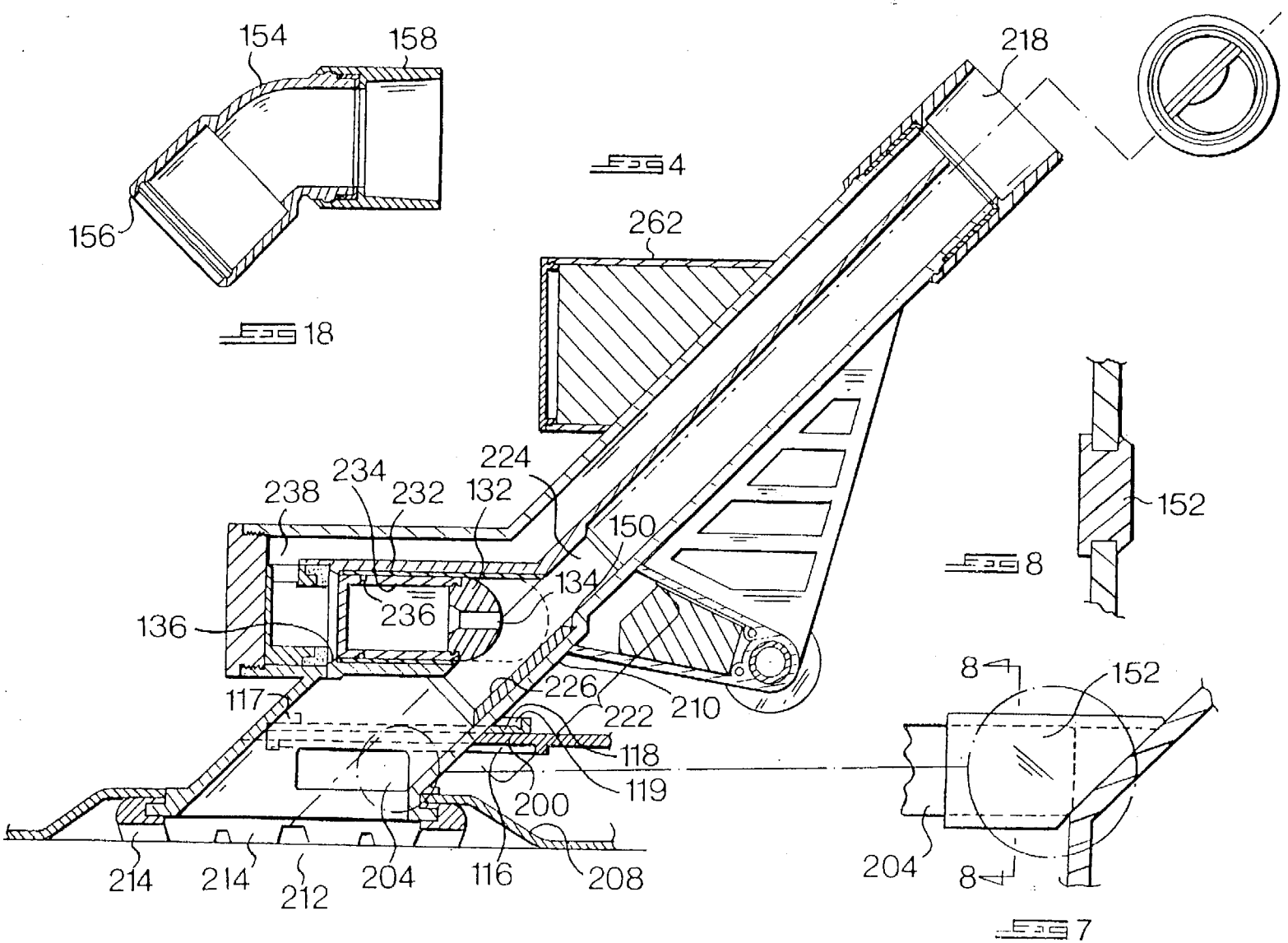
218
262
4
158
154
156
18
152
8
152
8
8
204
7
150
134
224
132
232
234
236
238
136
117
210
222
226
118
119
200
208
116
204
212
214
214

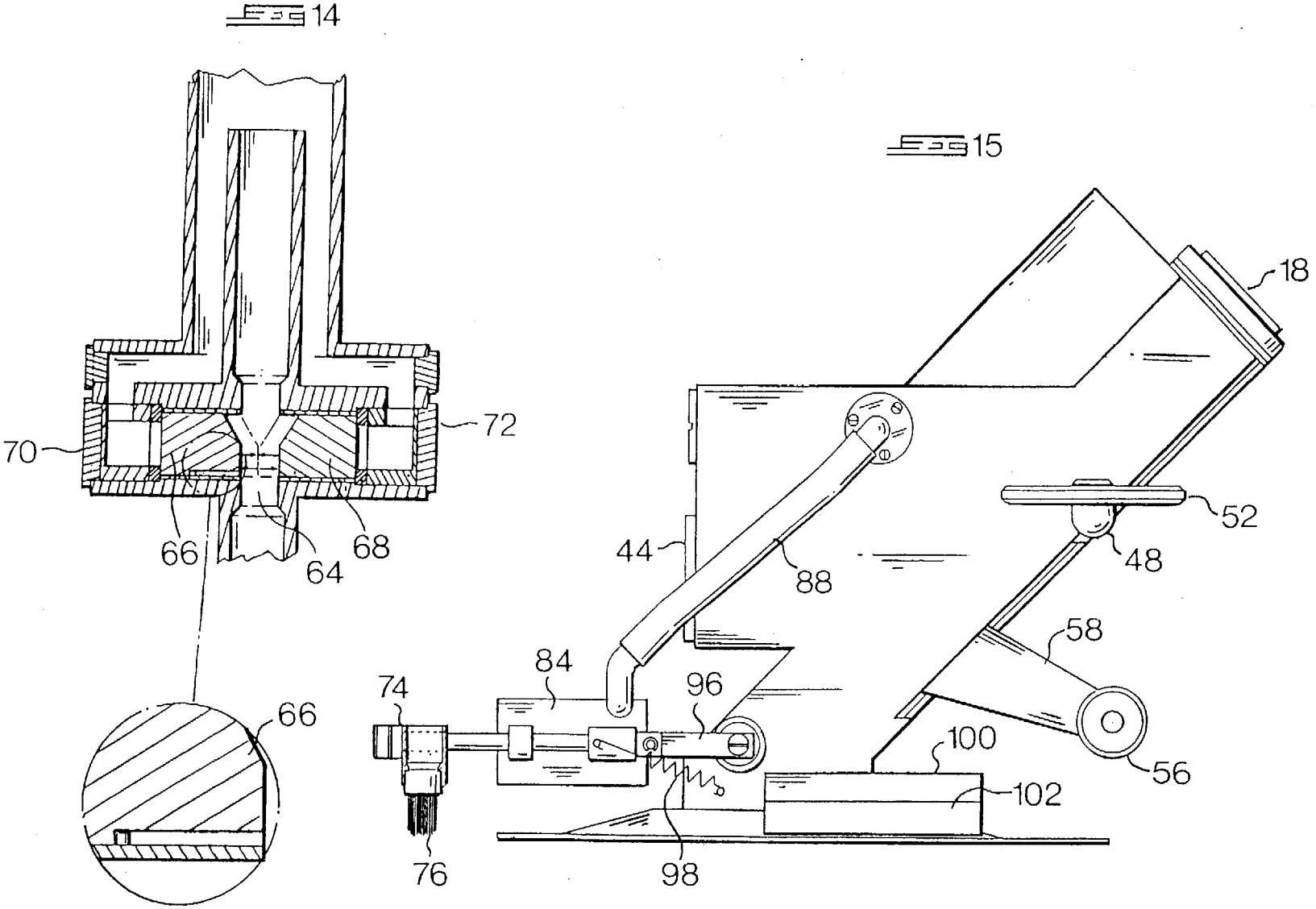
15
14
18
52
48
56
58
102
100
88
96
98
44
84
72
68
64
66
66
74
76
70

CLEANER FOR A SUBMERGED SURFACE

BACKGROUND OF THE INVENTION

1. Field of the Invention

THIS invention relates to a cleaner for a submerged surface such as the bottom and sides of a swimming pool.

2. Description of Background Art

Numerous suction-powered swimming pool cleaners have been proposed, and a number have been successful in the market place. Generally, those cleaners having a relatively small number of moving parts are the most reliable in long-term use, and are generally simpler and less expensive to manufacture.

Pool cleaners of this kind tend to fall into two categories, those employing an oscillating "hammer valve" or the like to periodically interrupt the flow of liquid through the pool cleaner, or those employing a flexible diaphragm which opens and closes as water passes through it. Pool cleaners of the first kind are more likely to jam as foreign objects pass through them, while the flexible diaphragm of the second kind of pool cleaner is more fragile and may be damaged by large or sharp objects.

It is an object of the invention to provide an alternative cleaner for a submerged surface.

SUMMARY OF THE INVENTION

According to the invention a cleaner for a submerged surface comprises a body defining an inlet for liquid, an outlet adapted for connection to a source of suction, a throat between the inlet and the outlet defining a region of reduced cross-sectional area relative to at least one of the inlet and the outlet, and a valve element adjacent the region of reduced cross-sectional area and movable reciprocally in a direction transverse to the axis of the throat between an extended position in which it substantially obstructs a flow of liquid through the throat and a retracted position in which it permits a flow of liquid through the throat.

The valve element may comprise a cylindrical body movable in a bore which intersects the throat.

The valve element may comprise a unitary moulded body, which may have a hemispherically curved end.

Instead, the valve element may comprise a moulded cylindrical body with a resilient head fitted thereto.

In either case, the valve element may have a bore formed therein to permit liquid to flow into or out of the interior of the body.

The angle of intersection of the valve bore and the throat relative to the inlet may be acute, and will typically be in the range of 30° to 60°, preferably about 45°.

The body preferably defines a passage between the valve bore and the outlet via which suction is applied to the valve element, in opposition to suction applied to the valve element due to reduced pressure in liquid flowing through the region of reduced cross-sectional area in the throat, thereby to induce reciprocation of the valve element.

A resilient member is preferably provided in the throat against which a first end of the valve element strikes as it moves between its retracted and extended positions.

In an alternative embodiment of the invention the cleaner includes first and second opposed valve elements each movable in a respective bore between a retracted position and an extended position in which the valve elements abut one another.

The cleaner may include auxiliary cleaning means comprising an actuator in fluid communication with the passage between the bore and the outlet, and a brush connected to the actuator, so that variations in the pressure in the passage cause oscillation of the brush.

Preferably the auxiliary cleaning means includes bias means for biasing the brush towards a surface on which the cleaner is operating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a front view of a second embodiment of a cleaner for a submerged surface according to the invention;

FIG. 4 is a sectional side view taken along the line 4—4 in FIG. 3;

FIG. 5 is an under plan view of a resilient foot of the cleaner of FIGS. 3 and 4;

FIG. 6 is a partial plan view of a bumper fitted to the cleaner of FIG. 3 and 4;

FIG. 7 is a partial sectional detail view of a suction inlet of the cleaner of FIGS. 3 and 4;

FIG. 8 is a section taken along the line 8—8 in FIG. 7;

FIG. 14 is a partial sectional view of a third alternative embodiment of the cleaner;

FIG. 15 is a side view of the cleaner of FIGS. 1 and 2, showing an auxiliary cleaning mechanism mounted thereon;

FIG. 18 is a sectional side view of an angled swivel connector usable with the cleaners of the invention.

DESCRIPTION OF THE PREFERRED EMBODIMENTS

Figure 2:
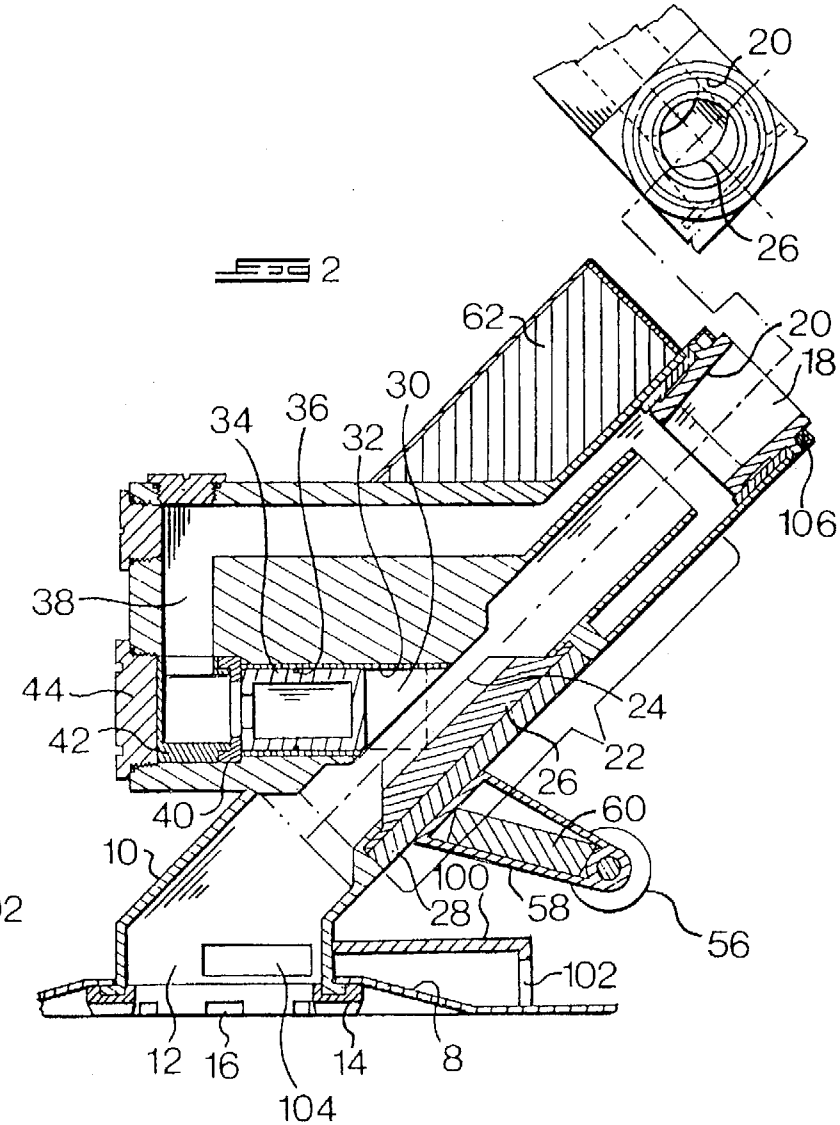
FIG. 2 is a sectional side view taken along the line 2—2 in FIG. 1.

The illustrated pool cleaner has a body 10 which is moulded from a tough plastics material and which defines an inlet 12 to the outer end of which is attached a circular foot 14 of resilient material. A flexible disc-shaped mantle 8 overlies the foot 14, helping to seal the foot against the surface to be cleaned. The foot rides on the submerged surface to be cleaned and has a number of recesses 16 formed in its periphery to transfer suction to the surface. A collector skirt 100 with openings 102 at its rear edge allows liquid flow into the inlet 12 via openings 104 in the sides of the body.

At the other end of the body is an outlet 18 which is fitted with a rotating hose connector 20 which receives a conventional flexible hose to allow the cleaner to be connected to a pool filter return inlet or another source of suction. Between the inlet 12 and the outlet 18 is a throat 22 which has a central portion 24 with a substantially reduced cross-sectional area relative to the rest of the throat and the inlet and outlet.

The central portion 24 of the throat is defined partially by a resilient member or wall element 26 which is held in position by a removable panel 28.

Adjacent to the central portion 24 of the throat 22 is a bore 30 which intersects the throat at an angle of approximately 45° and which is lined with a sleeve 32 of precision ground stainless steel or another low friction, hard wearing material. Within the bore 30 is a cylindrical shuttle valve element 34 which is preferably formed from a high density plastics material with low friction properties such as Ertalene HD or Ertalyte (trade marks), and which preferably has a density as close as possible to that of water.

A square-section seal 36 extends around the periphery of the shuttle 34. The seal 36 may comprise a composite material, such as a Teflon (trade mark)/bronze or Teflon/carbon composite. Alternatively, the seal may comprise a plastics material such as that used for the shuttle. The shuttle is retained in position in the bore by a stopper flange 40 of resilient material which in turn is held in position by a spacer 42 and a screw-in plug 44, allowing easy access to the shuttle for replacement or servicing.

As illustrated, the shuttle is open at one end, which makes it easy to manufacture. The closed end of the shuttle is shaped to engage sealingly with the resilient element 26 in central portion 24 of the throat. Other shapes for the shuttle are also possible (see below). The resilient nature of the element 26 protects both the throat of the cleaner and the shuttle itself from wear due to the impact of the shuttle against the element in use.

As indicated in FIG. 2, the shuttle is movable between the retracted position illustrated in solid outline, in which it does not obstruct a flow of liquid through the throat, and the extended position indicated in dotted outline in which it substantially blocks a flow of liquid through the throat.

Although in the described embodiment the shuttle contacts the resilient element 26 in the throat, the cleaner could operate without actual contact between the shuttle and the throat, for example, with a clearance of about 1 mm. This can be achieved, for example, by forming the shuttle with a shoulder or other stop formation which engages a complemental formation in the sleeve, thereby to limit the travel of the shuttle.

The body 10 defines an auxiliary suction passage 38 between the outlet 18 and the end of the shuttle remote from the throat, so that a degree of suction is applied to the shuttle at both ends thereof. The length and diameter of the passage 38 is calculated so that when the shuttle is in the retracted position illustrated in FIG. 2, the reduced pressure in the central portion 24 of the throat due to liquid flow through the throat tends to cause the shuttle to move into the throat, blocking the flow of liquid. With the shuttle in this position, the suction force applied to the rear of the shuttle now exceeds that tending to hold the shuttle in the throat, and the shuttle returns to its rest position. The resulting reciprocating motion of the shuttle, with periodic interruption of or obstruction of the flow of liquid through the pool cleaner body, causes the cleaner to move along the submerged surface being cleaned, in a manner similar to that of other pool cleaners which interrupt the flow of liquid through the body of the cleaner.

Figure 1:
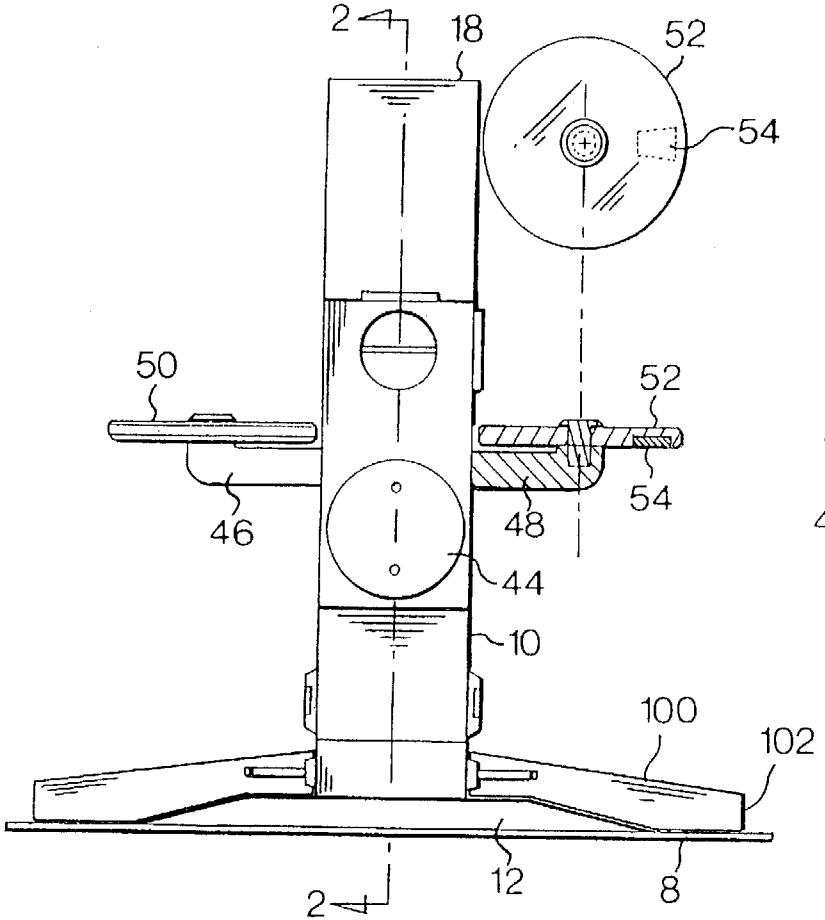
FIG. 1 is a front view of a first embodiment of a cleaner for a submerged surface according to the invention.
Figure 9:
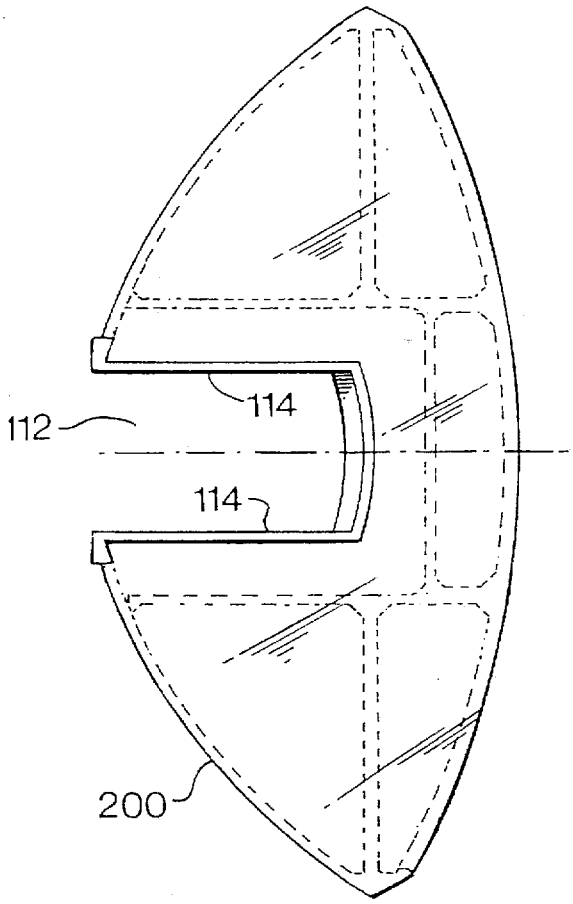
FIG. 9 is a plan view of a collector skirt of the apparatus of FIGS. 3 and 4.

As best seen in FIG. 1, the body 10 of the pool cleaner has a pair of arms 46 and 48 which extend on either side thereof and which carry bumper or deflector wheels 50 and 52 which are mounted for rotation in the same plane as the surface on which the pool cleaner moves. The wheel 52 has an auxiliary balance/steering weight 54 embedded in its surface adjacent to the periphery thereof. Apart from the deflector wheels 52, the cleaner has a further deflector wheel 56 which is mounted on a spar 58 which extends from the panel 28. The spar 58 is hollow and contains a weight 60 which is the main balance and steering weight of the machine, and orients it correctly relative to the submerged surface in use. At the top end of the machine is a flotation chamber 62 which co-operates with the weight 60 to orient the machine correctly in use.

A number of small spherical weights 106 are located around the hose connector 20 and can roll around it as the cleaner moves, to bias it towards the bottom of the pool.

A second embodiment of the cleaner is illustrated in FIGS. 3 and 4, with its associated components illustrated in FIGS. 5 to 13. The cleaner of FIGS. 3 and 4 is similar to that of FIGS. 1 and 2, but incorporates a number of refinements.

In FIGS. 3 and 4, parts which are equivalent to those of the embodiment of FIGS. 1 and 2 are given the same reference numerals, with a prefix "2". Thus, the body of the cleaner is designated 210 instead of 10.

The body 210 of the second embodiment of the cleaner defines a main inlet 212 via a central aperture in a resilient foot 214. Instead of being circular, the foot 214 is generally rhomboidal in shape, with a central circular aperture and a number of grooves or recesses 216 in its surface. The body 210 has a pair of openings 204 in its sides, above the main inlet 212, with a resilient wing-shaped collector skirt 200 which overlies the foot 214 and mantle 208 in use and which directs liquid from the surface to be cleaned towards the inlets 204.

The collector skirt 200 has a generally rectangular central opening 112, the inner edges 114 of which are received slidably between ridges 116 and 117 on the sides of the body 210. The collector skirt is retained in position on the body by a generally C-shaped clip or key plate 118 which clips into position against a ridged tab 119 on the body 210 of the cleaner, holding the collector skirt 200 releasably in place for easy removal and replacement thereof.

FIGS. 3 and 6 show a bumper arrangement 120 which comprises a pair of generally triangular wings 122 joined by a curved bridge portion 124 which is shaped to fit snugly over a flotation chamber 262 of the cleaner. The inner ends of the wings 122 are provided with grooves 126 which clip over ridges 128 formed on the sides of the flotation chamber 262 to clip the bumper arrangement releasably in place on the cleaner. At the outer ends of the wings 122 are resilient bumper wheels 130 which are retained rotatably in position on the ends of the wings. The bumper arrangement deflects the cleaner from obstacles in use.

Turning now to FIG. 4, the internal construction of the second embodiment of the cleaner is seen to be substantially similar to that of the first embodiment, although its construction is somewhat simplified and streamlined. The cleaner has a shuttle 234, the cylindrical body of which is moulded from the same material as that of the shuttle 34 described above. However, the shuttle 234 has a hemispherical clip-on head 132 which is formed of a tough, resilient plastics material such as polyurethane. The head 132 has a central through-bore 134 which permits liquid to flow into and out of the interior of the shuttle. Instead of being separately formed, the head can be moulded in place on the shuttle body.

The shuttle reciprocates in a stainless steel sleeve 232 and has a square section seal 236 similar to the seal 36 described above. To aid in fitting the shuttle into the sleeve, the latter is moulded into position in the body 210 with a 30° chamfer 136 defined adjacent the mouth of the sleeve to aid in compression of the seal as the shuttle is fitted into the sleeve.

Figure 11:
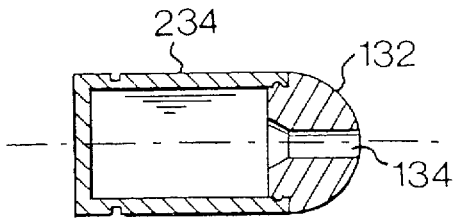
FIGS. 11, are sectional side views of alternative embodiments of a FIGS. 12 and 13 shuttle element of the apparatus of FIGS. 3 and 4.
Figure 12:
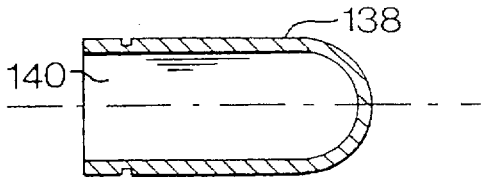
Figure 13:
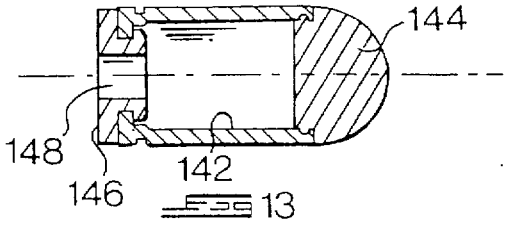
Figure 10:
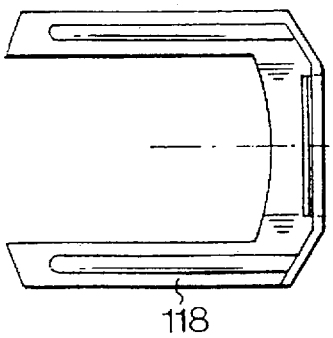
FIG. 10 is a plan view of a key plate used to hold the collector skirt in position on the cleaner.

A number of different shuttle embodiments are illustrated in FIGS. 11, 12 and 13. The shuttle of FIG. 11 corresponds to the shuttle shown in the cleaner of FIG. 4, while the shuttle of FIG. 12 is a simple, single-piece plastics moulding 138 with an open rear end 140. The shuttle element of FIG. 13 comprises a cylindrical body 142 with a solid hemispherical clip-on head 144 and a clip-on base 146 with a central through-bore 148.

The design of the shuttle element is important to the operation of the cleaner. Its length relative to the length of the bore in which it reciprocates, together with its mass and the dynamic characteristics given to it by any openings which it may have, determine its rate of oscillation or reciprocation in the bore, in turn affecting the speed of operation of the cleaner.

Referring again to FIG. 4, the throat of the cleaner has a resilient wall element 226 which, instead of being retained by a removable panel in the rear of the cleaner, is inserted via the inlet 212 and held frictionally in position, with its edges being chamfered so as to fit into complementary chamfered grooves 150 defined in the throat region of the cleaner. The point of contact between the wall element and the head of the shuttle is towards one end of the wall element, so that it can be reversed and replaced when worn.

A further refinement provided on the cleaner of FIGS. 3 and 4 comprises a pair of clip-in inserts 152 which clip into and partially occlude the inlets 204, thereby reducing the flow of liquid through the inlets 204 relative to the flow through the main inlet 212. This may be desirable, for example, where the cleaner has to operate with reduced suction or on a slippery surface.

FIG. 18 shows an angled swivel connector 154 which has a first end 156 which can clip rotatably to the outlet 18/218 of the cleaner and which has a second swivel joint 158 at its other end to prevent "wind-up" of a hose attached to the cleaner. The body of the connector 154 is angled at 45° so that it accommodates pools in which the cleaner is forced to operate on angled surfaces.

FIG. 14 shows a third, alternative version of the cleaner in which a pair of opposed shuttle valves are provided on either side of the throat of the device. In FIG. 14, the throat 64 is obstructed periodically by movement of the valve shuttles 66 and 68 towards one another due to a zone of reduced pressure in the throat. In this embodiment, the bores in which the shuttles travel intersect the throat at 90°. The shuttles are retained in the same manner as in the embodiment of FIGS. 1 and 2, and are accessible via plugs 70 and 72.

The shuttles 66 and 68 are constrained against rotation and movement past the centre of the throat, for example by pins in the sleeves which engage with axial grooves formed in the surface of each shuttle. The shuttles can abut one another to fully obstruct the flow of liquid through the throat, or may be arranged to stop short of contact with one another on their outward strokes.

Figure 16:
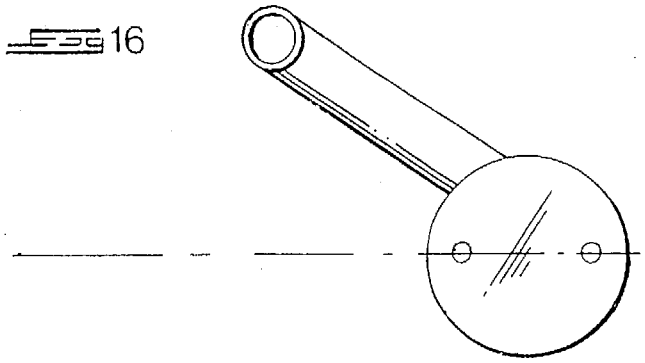
FIG. 16 is a sectional side view of the auxiliary cleaning mechanism.
Figure 17:
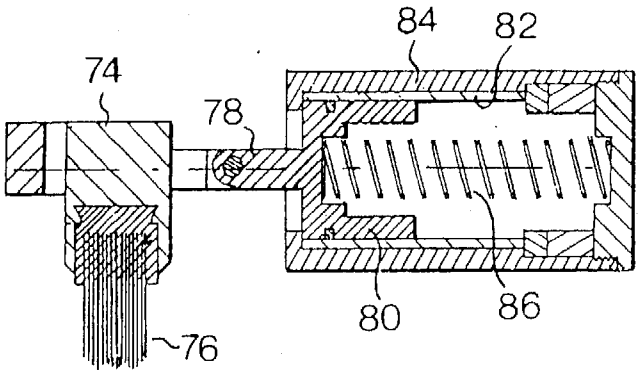
FIG. 17 is a top view of the auxiliary cleaning mechanism.

Referring now to FIGS. 15, 16 and 17, an auxiliary cleaning device is shown which can be fitted to the pool cleaner. The device comprises a brush head 74 with downwardly extending bristles 76. The brush head 74 is connected pivotably to an arm 78 of an actuator piston 80 which is slidable in a sleeve 82 in an actuator body 84. A coil spring 86 biases the actuator piston 80 into the extended position illustrated in FIG. 15.

The interior of the actuator is connected to the passage 38 of the pool cleaner via a flexible tube 88, so that variations in the suction within the passage 38 are transmitted to the interior of the actuator, causing the actuator piston 80 to reciprocate together with the shuttle 34, and thus causing the brush to scrub the submerged surface over which the cleaner is moving. Instead of a brush, an abrasive pad or strip can be fitted.

The brush head 74 is supported slidably on a pair of arms 90 and 92, and the entire brush assembly is mounted pivotably on arms 94 and 96 which are fixed to the body 10 of the pool cleaner. This arrangement allows the entire brush assembly to lift up and away from the submerged surface, against the urging of a spring 98, to allow the cleaner to negotiate corners and curved surfaces.

The described pool cleaner has been found to work effectively and to be relatively resistant to becoming obstructed by debris passing through the cleaner. The design of the pool cleaner also facilitates maintenance and replacement of parts, although the device is relatively simple in construction and should not require frequent maintenance in use.

The relationship between the dimensions of the shuttle, the throat and its narrowed central portion, and the auxiliary suction passage are selected so that when debris of substantial size passes through the throat, the shuttle tends to pause in the retracted position, avoiding jamming of the cleaner.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cleaner for a submerged surface comprising:

a body defining an inlet for liquid;

an outlet adapted for connection to a source of suction;

a throat positioned between the inlet and the outlet defining a region of reduced cross-sectional area relative to at least one of the inlet and the outlet;

a valve element adjacent the region of reduced cross-sectional area and movable reciprocally in a valve bore which intersects the throat in a direction transverse to the axis of the throat between an extended position in which it substantially obstructs a flow of liquid through the throat and a retracted position in which it permits a flow of liquid through the throat; and a passage defined by the body between the valve bore and the outlet via which suction is applied to the valve element, in opposition to suction applied to the valve element due to reduced pressure in liquid flowing through the region of reduced cross-sectional area in the throat, thereby to induce reciprocation of the valve element.

2. The cleaner according to claim 1, wherein the valve element comprises a cylindrical body.

3. The cleaner according to claim 2, wherein the cylindrical body of the valve element comprises a unitary moulded body.

4. The cleaner according to claim 3, wherein the body of the valve element has a hemispherically curved end.

5. The cleaner according to claim 2, wherein the cylindrical body of the valve element comprises a moulded cylindrical body with a resilient head fitted thereto.

6. The cleaner according to claim 2, wherein the cylindrical body of the valve element has a bore formed therein to permit liquid to flow into or out of the interior thereof.

7. The cleaner according to claim 1, wherein the angle of intersection of the valve bore relative to the throat is acute.

8. The cleaner according to claim 7, wherein the angle is in the range of 30° to 60°.

9. The cleaner according to claim 8, wherein the angle is about 45°.

10. The cleaner according to claim 1, including auxiliary cleaning means comprising an actuator in fluid communication with the passage between the bore and the outlet, and a brush connected to the actuator, so that variations in the pressure in the passage cause oscillation of the brush.

11. The cleaner according to claim 10, including bias means for biasing the brush towards a surface on which the cleaner is operating.

12. A cleaner for a submerged surface comprising:

a body defining an inlet for liquid;

an outlet adapted for connection to a source of suction;

a throat positioned between the inlet and the outlet defining a region of reduced cross-sectional area relative to at least one of the inlet and the outlet;

a valve element adjacent the region of reduced cross-sectional area and movable reciprocally in a valve bore which intersects the throat in a direction transverse to the axis of the throat between an extended position in which it substantially obstructs a flow of liquid through the throat and a retracted position in which it permits a flow of liquid through the throat; and a resilient member provided in the throat against which a first end of the valve element strikes as it moves between its retracted and extended positions.

13. A cleaner for a submerged surface comprising:

a body defining an inlet for liquid;

an outlet adapted for connection to a source of suction;

a throat positioned between the inlet and the outlet defining a region of reduced cross-sectional area relative to at least one of the inlet and the outlet;

a valve element adjacent the region of reduced cross-sectional area and movable reciprocally in a valve bore which intersects the throat in a direction transverse to the axis of the throat between an extended position in which it substantially obstructs a flow of liquid through the throat and a retracted position in which it permits a flow of liquid through the throat; and the valve element includes first and second opposed valve elements each movable in a respective bore between a retracted position and an extended position in which the valve elements abut one another.

* * * * *